US006708902B2

(12) United States Patent
Takeshi et al.

(10) Patent No.: US 6,708,902 B2
(45) Date of Patent: Mar. 23, 2004

(54) FOAM WATER DELIVERY PORT

(75) Inventors: Takaki Takeshi, Kitakyushu (JP); Nagaishi Masayuki, Kitakyushu (JP); Fukuda Yukihiro, Kitakyushu (JP); Usui Hiroyuki, Kitakyushu (JP); Kitazaki Satoru, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 11 days.

(21) Appl. No.: 10/221,050

(22) PCT Filed: Mar. 15, 2001

(86) PCT No.: PCT/JP01/02039

§ 371 (c)(1),
(2), (4) Date: Sep. 9, 2002

(87) PCT Pub. No.: WO01/68995

PCT Pub. Date: Sep. 20, 2001

(65) Prior Publication Data

US 2003/0029935 A1 Feb. 13, 2003

(30) Foreign Application Priority Data

Mar. 17, 2000 (JP) ..... 2000-076759
May 29, 2000 (JP) ..... 2000-163130

(51) Int. Cl.[7] ..... E03C 1/08
(52) U.S. Cl. ..... 239/428.5; 239/553.5
(58) Field of Search ..... 239/428.5, 553.3, 239/553.5

(56) References Cited

U.S. PATENT DOCUMENTS 2,670,942 A 3/1954 Aghnides
2,832,577 A 4/1958 Goodrie et al.
3,130,917 A * 4/1964 Aghnides ..... 239/428.5
3,851,825 A * 12/1974 Parkison et al. ..... 239/590.3
4,119,276 A * 10/1978 Nelson ..... 239/590.3
4,470,546 A * 9/1984 Wildfang ..... 239/428.5
4,624,415 A * 11/1986 Hofstetter, Jr. ..... 239/590.3
4,971,252 A * 11/1990 Tasaki et al. ..... 239/428.5
4,991,778 A * 2/1991 Maas et al. ..... 239/333
5,114,072 A 5/1992 Barhydt, Sr.
5,467,929 A * 11/1995 Bosio ..... 239/428.5
6,588,682 B1 * 7/2003 Flieger ..... 239/428.5

FOREIGN PATENT DOCUMENTS

DE 30 00 799 A1 7/1981
DE 94 18 847 U 2/1995
EP 3903800 A1 * 8/1990
FR 2 473 585 7/1981
JP 56-100937 8/1981

* cited by examiner

*Primary Examiner*—William E. Tapolcal
*Assistant Examiner*—Mohammad M. Ali
(74) *Attorney, Agent, or Firm*—Griffin & Szipl, PC

(57) ABSTRACT

A water aerator comprises an inlet for wash water, an outlet a bubbly stream, first means for mixing air with wash water disposed in a wash water passage extending between the inlet for wash water and the outlet for the bubbly stream, and second means for rectifying the wash water disposed downstream of the first means. The first means comprises a pressure reducing disk provided with a plurality of pores and blocking the wash water passage, air inlets disposed in a circumferential wall of the wash water passage downstream of the pressure reducing disk, and a tapered zone of the wash water passage with conically diminishing diameter located downstream of the pressure reducing disk. The second means comprises a rectifying zone of the wash water passage extending between the downstream end of the tapered zone and the outlet for the bubbly stream, and a honeycomb disposed in the rectifying zone. The pores in the pressure reducing disk are directed to a circumferential wall of the tapered zone.

17 Claims, 6 Drawing Sheets

(a)

(b)

FOAM WATER DELIVERY PORT

TECHNICAL FIELD

The present invention relates to a water aerator used in a hand washing apparatus, water faucet, etc.

BACKGROUND ART

A water aerator provided with an inlet for wash water, an outlet for a bubbly stream, and an air mixing mechanism disposed in a wash water passage extending between the inlet for wash water and the outlet for the bubbly stream is disclosed in U.S. Pat. No. 5,114,072. In the water aerator, the air mixing mechanism has a pressure reducing disk provided with a plurality of pores and blocking the wash water passage, air inlets formed in the circumferential wall of the wash water passage downstream of the pressure reducing disk, and a rectifying mesh disposed downstream of the air inlets.

In the water aerator of U.S. Pat. No. 5,114,072, a shower of wash water discharges from the plurality of pores in the pressure reducing disk. The shower of wash water entrains air flowing into the wash water passage through the air inlets due to friction working between them and collides against the rectifying mesh. The air entrained by the shower of wash water becomes an abundance of air bubbles when the shower of wash water passes through the rectifying mesh to be broken up. The air bubbles disperse in the wash water to form a bubbly stream of wash water. The bubbly stream of wash water discharges from the outlet for the bubbly stream.

DISCLOSURE OF INVENTION

The shower of wash water must be prevented from discharging from the pores of the pressure reducing disk at a high speed so as to prevent a backflow of the wash water toward the air inlets. This is because the wash water cannot pass through the rectifying mesh at a high speed due to the large flow resistance of the rectifying mesh. Therefore, the water aerator of U.S. Pat. No. 5,114,072 has a disadvantage in that it cannot discharge the shower of wash water at a high speed from the pores of the pressure reducing disk, suck a large quantity of air entrained by the high-speed shower of wash water, propel the high-speed shower of wash water against the rectifying mesh to break it up, and mix a large quantity of air with the shower of wash water.

Therefore, an object of the present invention is to provided a water aerator which can discharge a shower of wash water at a high speed from pores in a pressure reducing disk, suck a large quantity of air, and mix a large quantity of air with the wash water.

In one aspect, the present invention provides a water aerator comprising an inlet for wash water, an outlet for a bubbly stream, first means for mixing air with wash water disposed in a wash water passage extending between the inlet for wash water and the outlet for the bubbly stream, and second means for rectifying the wash water disposed downstream of the first means, wherein the first means comprises a pressure reducing disk provided with a plurality of pores and blocking the wash water passage, air inlets formed in a circumferential wall of the wash water passage downstream of the pressure reducing disk, and a tapered zone of the wash water passage with conically diminishing diameter disposed downstream of the pressure reducing disk, wherein the second means comprises a rectifying zone of the wash water passage extending between the downstream end of the tapered zone and the outlet for the bubbly stream, and a honeycomb disposed in the rectifying zone, and wherein the pores in the pressure reducing disk are directed to a circumferential wall of the tapered zone.

In the water aerator of the present invention, a shower of wash water discharges from the plurality of pores in the pressure reducing disk. The shower of wash water entrains air flowing into the wash water passage through the air inlets due to friction working between them and collides against the tapered zone of the wash water passage to be broken up. When the shower of wash water is broken up, the air entrained by the shower of wash water becomes an abundance of air bubbles to disperse in the wash water, thereby forming a bubbly stream of the wash water. The bubbly stream of the wash water passes through the tapered zone into the rectifying zone to be rectified by passing through the rectifying zone and also by passing through the honeycomb. The rectified bubbly stream discharges from the outlet for the bubbly stream.

In the water aerator according to the present invention, the bubbly stream can pass through the honeycomb at a high speed because the flow resistance of the honeycomb is less than that of the rectifying mesh. Therefore, the water aerator in accordance with the present invention can discharge the shower of wash water at a high speed from the pores in the pressure reducing disk, suck a large quantity of air, and mix a large quantity of air with the wash water.

In accordance with a preferred embodiment of the present invention, a circumferential wall of the rectifying zone continuously connects with the circumferential wall of the tapered zone.

In this embodiment of the water aerator, a part of the bubbly stream running along the circumferential wall of the tapered zone flies off the downstream end of the tapered zone toward the radial center of the rectifying zone to gather and form a converged stream there. The remaining part of the bubbly stream running along the circumferential wall of the tapered zone passes by the downstream end of the tapered zone into the rectifying zone to run along the circumferential wall of the rectifying zone without flying out the downstream end of the tapered zone, thereby forming a cylindrical film of water. The converged bubbly stream passes through the central portion of the honeycomb. The cylindrical film of the bubbly stream is divided into an abundance of fine converged flows dispersed in the circumferential direction and in the radial direction when it passes through the honeycomb. The converged bubbly stream discharges from the central portion of the outlet for the bubbly stream and an abundance of fine converged bubbly streams uniformly dispersed in the circumferential direction and in the radial direction discharge from all portions of the outlet for the bubbly stream other than the central portion. The central converged bubbly stream and an abundance of the fine converged bubbly streams uniformly dispersed around the central converged bubbly stream are united to form a stable, thick converged bubbly stream. The stable, thick converged bubbly stream is visually satisfying to the user of a hand washing apparatus equipped with the water aerator.

In accordance with a preferred embodiment of the present invention, the pores in the pressure reducing disk are disposed at a constant pitch along a circle with a diameter larger than that of the downstream end of the tapered zone of the wash water passage.

In this embodiment of the water aerator, it is possible to direct the pores at right angles to end faces of the pressure reducing disk, and discharge the wash water from the pores without deflecting stream lines of the wash water directed at right angles to the end faces of the pressure reducing disk because the pores in the pressure reducing disk are disposed along a circle with a diameter larger than that of the downstream end of the tapered zone of the wash water passage. Pressure loss due to deflections of the stream lines of the wash water is not generated. Therefore, the shower of wash water discharges at a high speed from the pores in the pressure reducing disk.

In accordance with a preferred embodiment of the present invention, inlet side corners of the pores in the pressure reducing disk are rounded.

In this embodiment of the water aerator, it is possible to prevent contraction of the flows of the wash water passing through the pores and reduction of flow speed of the shower of wash water because inlet side corners of the pores in the pressure reducing disk are rounded.

In accordance with a preferred embodiment of the present invention, the air inlets are disposed upstream of the tapered zone.

In this embodiment of the water aerator, the quantity of sucked air increases and the quantity of air mixed with the wash water increases because the air inlets are disposed close to the high-speed shower of wash water before the collision against the tapered zone of the wash water passage.

In accordance with a preferred embodiment of the present invention, the corner at the connection of the circumferential wall of the tapered zone with the circumferential wall of the rectifying zone is rounded.

In this embodiment of the water aerator, flow resistance at the connection of the tapered zone with the rectifying zone is reduced and the speed reduction of the bubbly stream at the connection of the tapered zone with the rectifying zone is prevented because the corner at the connection of the circumferential wall of the tapered zone with the circumferential wall of the rectifying zone is rounded.

In accordance with a preferred embodiment of the present invention, the rectifying zone of the wash water passage increases in diameter toward the downstream.

In this embodiment of the water aerator, the outlet for bubbly stream increases in diameter, the bubbly stream discharging from the outlet for bubbly stream increases in diameter, and the user of a hand washing apparatus is more visually satisfied because the rectifying zone of the wash water passage increases in diameter toward the downstream.

In accordance with a preferred embodiment of the present invention, the honeycomb comprises a central hole and a plurality of peripheral holes disposed radially around the central hole.

In this embodiment of the water aerator, the converged bubbly stream running through the central portion of the rectifying zone passes through the central hole without interfering with partitions of the honeycomb and without becoming turbulent. The cylindrical curtain of the bubbly stream running along the circumferential wall of the rectifying zone passes through the plurality of peripheral holes disposed radially around the central hole to form an abundance of fine converged bubbly streams uniformly dispersed in the circumferential direction and in the radial direction around the converged bubbly stream passed through the central hole. The central converged bubbly stream without turbulence and an abundance of the peripheral fine converged bubbly streams uniformly dispersed in the circumferential direction and in the radial direction around the central converged bubbly stream are united to form a stable, thick converged bubbly stream. The user of a hand washing apparatus is visually satisfied by the stable, thick converged bubbly stream.

In accordance with a preferred embodiment of the present invention, the holes of the honeycomb increase in diameter toward the downstream.

In this embodiment of the water aerator, the converged bubbly streams discharging from the holes of the honeycomb come close to each other and unite easily because the holes of the honeycomb increase in diameter toward the downstream.

In accordance with a preferred embodiment of the present invention, the rectifying zone extends downstream beyond the honeycomb.

In this embodiment of the water aerator, the central converged bubbly stream and an abundance of the fine converged bubbly streams unite easily because the rectifying zone extends downstream beyond the honeycomb.

In accordance with a preferred embodiment of the present invention, the water aerator further comprises means for preventing backflow of the wash water toward the air inlets.

In this embodiment of the water aerator, clogging of the air inlets by the wash water is prevented and stoppage of air suction is prevented by the means for preventing backflow.

In accordance with a preferred embodiment of the present invention, the water aerator comprises an internal cylinder provided with the air inlets, the tapered zone, the rectifying zone and the honeycomb and receiving the pressure reducing disk, and an external cylinder receiving the internal cylinder and forming an air passage communicating with the air inlets between itself and the internal cylinder.

The provision of the internal cylinder and the external cylinder reduces the number of elements of the water aerator and facilitates the work of assembling the water aerator.

In accordance with a preferred embodiment of the present invention, the water aerator comprises an internal cylinder provided with the air inlets, the tapered zone, the rectifying zone and the honeycomb and receiving the pressure reducing disk united with the means for preventing backflow, and an external cylinder receiving the internal cylinder and forming an air passage communicating with the air inlets between itself and the internal cylinder.

The provision of the internal cylinder and the external cylinder reduces the number of elements of the water aerator, facilitates the work of assembling the water aerator, and prevents backflow of the wash water toward the air inlets.

In accordance with a preferred embodiment of the present invention, the water aerator comprises a flow regulating valve disposed upstream of the pressure reducing disk.

The provision of the flow regulating valve suppresses fluctuation of the flow rate of the discharging wash water due to fluctuation of the supply pressure of the wash water and stabilizes the discharging of the wash water.

In accordance with a preferred embodiment of the present invention, the water aerator discharges the bubbly stream at a flow rate of wash water of 2 L/minute and 100 volume % of air mixed with the wash water.

The user of a hand washing apparatus equipped with the water aerator is tactually satisfied by the flow rate of the wash water onto the palms and visually satisfied by the bubbly stream with a 4 L/minute flow rate.

In another aspect, the present invention provides a hand washing apparatus equipped with any one of the aforementioned water aerators.

In another aspect, the present invention provides a water faucet provided with any one of the aforementioned water aerators.

The water aerator in accordance with the present invention can be used for a hand washing apparatus, a water faucet, etc.

BEST MODE FOR CARRYING OUT THE INVENTION

A water aerator in accordance with a preferred embodiment of the present invention used for a hand washing apparatus will be described.

Figure 1:
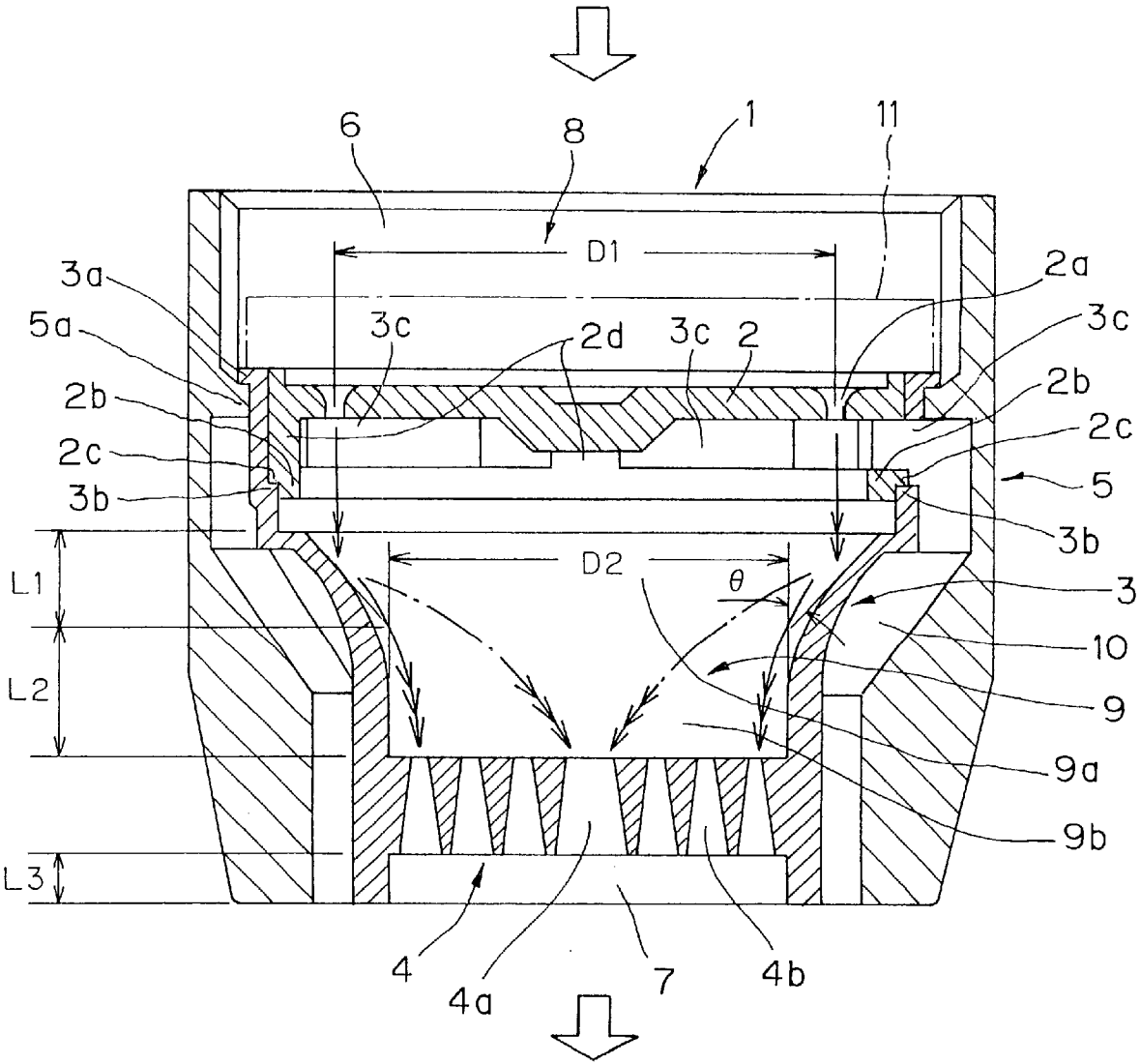
FIG. 1 is a vertical sectional view of a water aerator for a hand washing apparatus in accordance with a preferred embodiment of the present invention.
Figure 2:
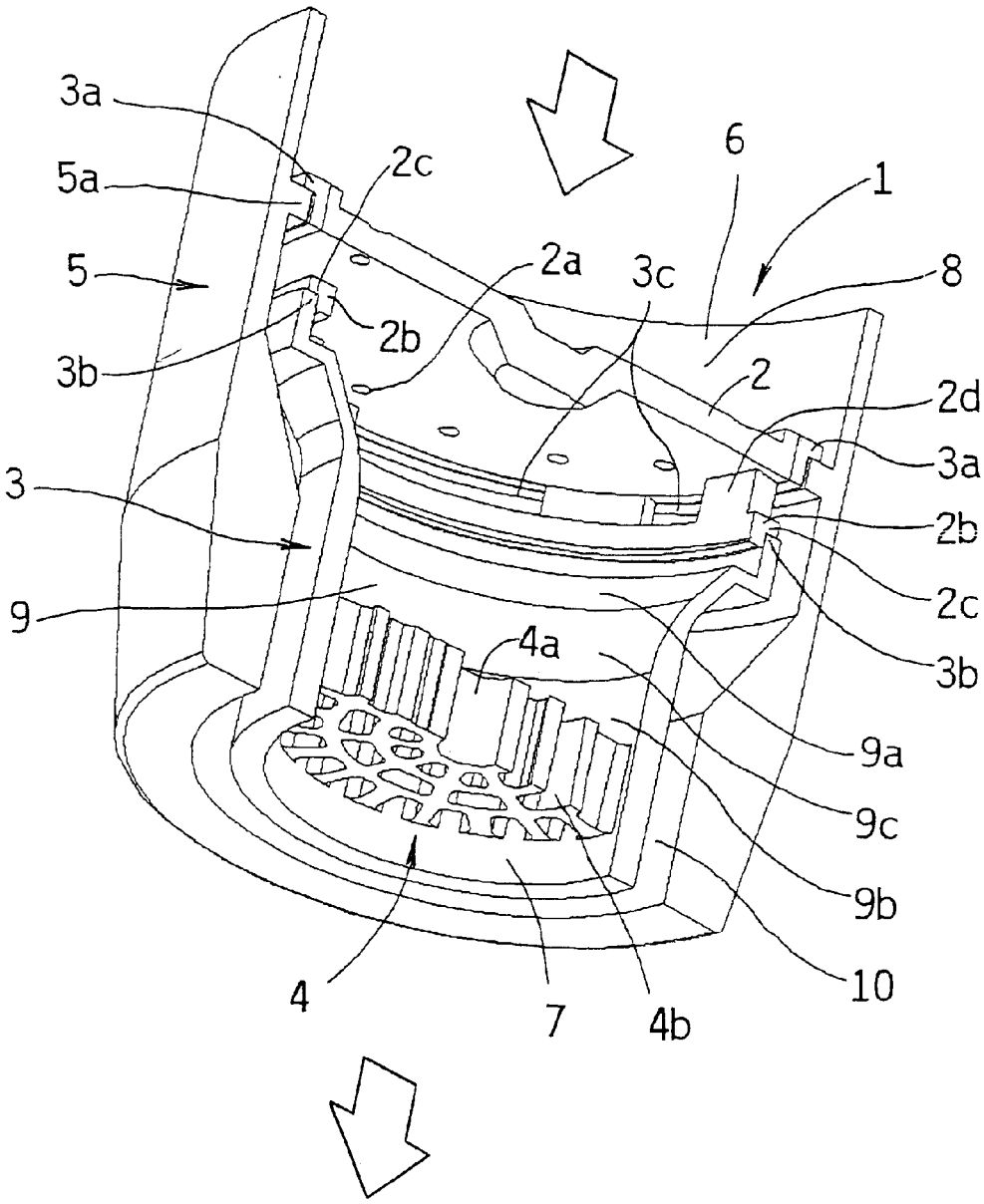
FIG. 2 is a perspective view of a half portion of a water aerator for a hand washing apparatus in accordance with a preferred embodiment of the present invention.
Figure 3:
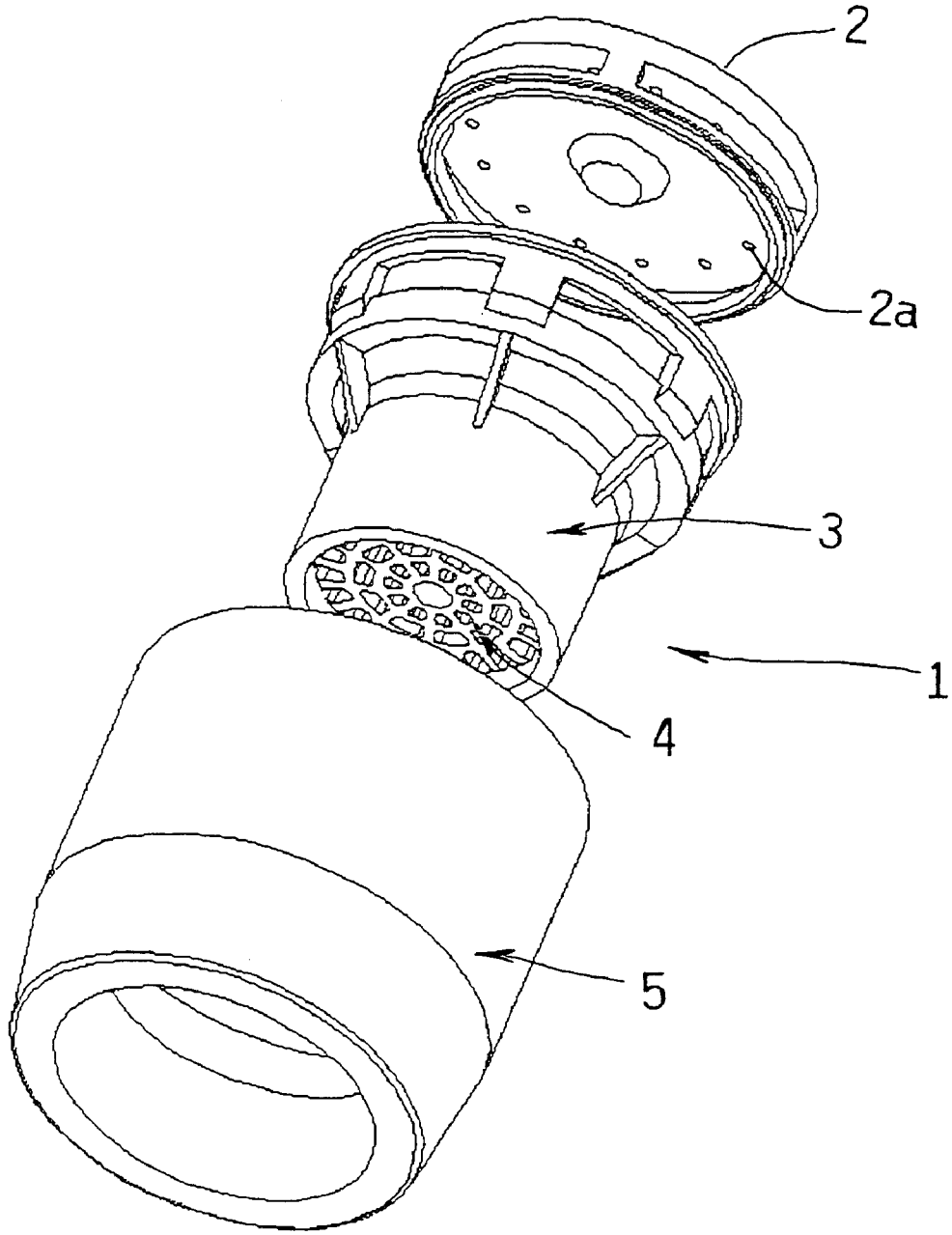
FIG. 3 is an exploded perspective view of a water aerator for a hand washing apparatus in accordance with a preferred embodiment of the present invention.

As shown in FIGS. 1 to 3, a water aerator 1 for a hand washing apparatus is provided with a pressure reducing disk 2, an internal cylinder 3, and a honeycomb disk 4. These members are disposed in series in the order of the pressure reducing disk 2, the internal cylinder 3 and the honeycomb disk 4 from upstream to downstream relative to the wash water flow. The water aerator 1 is further provided with an external cylinder 5 for receiving the aforementioned members. The pressure reducing disk 2, the internal cylinder 3, the honeycomb disk 4 and the external cylinder 5 are disposed coaxially. The upstream end of the external cylinder 5 forms a wash water inlet 6 and the downstream end of the internal cylinder 3 forms a bubbly stream outlet 7. The internal space of the external cylinder upstream of the pressure reducing disk 2 forms a wash water passage 8 and the internal space of the internal cylinder 3 forms a wash water passage 9.

The pressure reducing disk 2 is provided with a plurality of pores 2*a* at its outer peripheral portion. The pores 2 are disposed along a circle with a diameter of D1 at a constant pitch. The circle is disposed coaxially with the pressure reducing disk 2. The pores 2 extend at right angles to the end faces of the pressure reducing disk 2. The corners of the pores 2 on the inlet side are rounded. The pressure reducing disk 2 blocks the upstream end of the wash water passage 9.

An annulus ring 2*b* for preventing backflow is disposed close to the pressure reducing disk 2, downstream of the pressure reducing disk 2 relative to the wash water flow and coaxially with the pressure reducing disk 2. The annulus ring 2*b* has an inner diameter larger than D1. The annulus ring 2*b* is provided with an annular step 2*c* at the outer periphery of its downstream end. The annulus ring 2*b* is connected to the pressure reducing disk 2 with a plurality of connecting columns 2*d* with arcuate cross section disposed at a predetermined pitch in the circumferential direction. The pressure reducing disk 2, the annulus ring 2*b* for preventing backflow and the connecting columns 2*d* are formed integrally with each other.

The internal cylinder 3 is provided with an outer flange 3*a* at its upstream end relative to the wash water flow. The internal cylinder 3 is provided with an annular step 3*b* at the inner circumferential surface of its upstream portion. The internal cylinder 3 is provided with a plurality of air inlets 3*c* at its circumferential wall extending between the outer flange 3*a* and the annular step 3*b*. The air inlets 3*c* are spaced from each other in the circumferential direction.

The inner diameter of the internal cylinder 3 conically diminishes downstream of the annular step 3*b* to become the same as that of the downstream end of the internal cylinder 3 forming the bubbly stream outlet 7. Thereafter, the internal cylinder 3 extends straight to the downstream end. Therefore, the wash water passage 9 is provided with a tapered zone 9*a* conically diminishing in diameter downstream of the air inlets 3*c* and a rectifying zone 9*b* extending straight between the downstream end of the tapered zone 9*a* and the bubbly stream outlet 7. The rectifying zone 9*b* is disposed coaxially with the bubbly stream outlet 7 and its diameter is the same as that of the bubbly stream outlet 7. The diameter D2 of the downstream end of the tapered zone 9*a* is set smaller than the diameter D1 of the circle along which the pores 2*a* are disposed. Therefore, the pores 2*a* are directed to the circumferential wall of the tapered zone 9*a*.

The circumferential wall of the tapered zone 9*a* continuously connects with the circumferential wall of the rectifying zone 9*b*. The corner of the connection of the two circumferential walls is rounded.

The honeycomb 4 is provided with a large central hole 4*a* and numerous small peripheral holes 4*b* disposed radially around the large central hole 4*a*. The large central hole 4*a* and the small peripheral holes 4*b* increase in diameter from the upstream toward the downstream. The internal cylinder 3 and the honeycomb 4 are formed integrally with each other. The rectifying zone 9*b* of the wash water passage 9 extends downstream beyond the honeycomb 4.

The external cylinder 5 is provided with an inner flange 5*a* at its upstream portion.

The pressure reducing disk 2 internally engages the upstream end of the internal cylinder 3. The annular step 2*c* of the annulus ring 2*b* for preventing backflow engages the annular step 3*b* of the internal cylinder 3 and the outer circumferential surfaces of the pressure reducing disk 2 and the connecting columns 2*d* are forced against the inner circumferential surface of the upstream portion of the internal cylinder 3. Thus, the pressure reducing disk 2 is fixed to internal cylinder 3.

The internal cylinder 3 internally engages the external cylinder 5. The outer flange 3*a* of the internal cylinder 3 engages the inner flange 5*a* of the external cylinder 5, a packing not shown in Figures is put on the outer flange 3*a*, and the external cylinder 5 is screwed on a joint of a water faucet not shown in Figures. Thus, the internal cylinder 3 fixedly engages the external cylinder 5. A cylindrical space between the outer circumferential surface of the internal cylinder 3 and the inner circumferential surface of the external cylinder 5 forms an air passage 10.

The pressure reducing disk 2, the internal cylinder 3 and the external cylinder 5 are assembled as a unitary body to form the water aerator 1.

The pressure reducing disk 2, the air inlets 3*c*, the air passage 10 and the circumferential wall of the tapered zone 9*a* of the wash water passage form an air mixing mechanism. The rectifying zone 9*b* of the wash water passage and the honeycomb 4 form a rectifying mechanism.

The water aerator 1 structured as aforementioned is connected with the outlet of a water faucet to form a hand washing apparatus.

In the water aerator 1, wash water flows into the wash water passage 8 through the wash water inlet 6 as indicated by a void arrow in FIGS. 1 and 2, passes through the plurality of pores 2*a*, and discharges into the wash water passage 9 as a high-speed shower of wash water as indicated by double arrows in FIG. 1.

The shower of wash water forms a high-speed, finely-divided cylindrical screen-like flow having a large contact surface with air. Air flows into the wash water passage 9 through the air passage 10 and the air inlets 3*c*. The high-speed, finely-divided cylindrical screen-like flow entrains air due to friction working between them and collides against the circumferential wall of the tapered zone 9*a* of the wash water passage, thereby being broken up. The air is sucked into the wash water passage 9 through the air inlets 3*c* as the high-speed, finely-divided cylindrical screen-like flow entrains the air. When the high-speed, finely-divided cylindrical screen-like flow collides against the circumferential wall of the tapered zone 9*a* of the wash water passage to be broken up, the air entrained by the high-speed, finely-divided cylindrical screen-like flow becomes an abundance of micro air bubbles. The air bubbles are mixed with and disperse into the wash water to form a bubbly stream of the wash water.

A part of the wash water striking against the circumferential wall of the tapered zone 9*a* of the wash water passage is reflected by the wall and flows backward along the circumferential wall of the tapered zone 9*a* toward the upstream. The backflow collides against the annulus ring 2*b* for preventing backflow to be directed to the downstream.

The finely-divided cylindrical screen of the bubbly stream runs along the circumferential wall of the tapered zone 9*a* of the wash water passage to diminish in diameter. Thus, the numerous linear flows forming the finely-divided screen are united to form a conical screen of the bubbly stream. The conical screen of the bubbly stream runs into the rectifying zone 9*b* of the wash water passage. As indicated by phantom triple arrows in FIG. 1, a part of the screen of the bubbly stream flies off the lower end of the circumferential wall of the tapered zone 9*a* to gather around the radial center of the rectifying zone 9*b*, thereby forming a converged flow. As indicated by solid triple arrows in FIG. 1, the remaining part of the screen of the bubbly stream transfers from the lower end of the circumferential wall of the tapered zone 9*a* to the circumferential wall of the rectifying zone 9*b* to form a cylindrical screen of the bubbly stream. The cylindrical screen of the bubbly stream runs along the circumferential wall of the rectifying zone 9*b*. While the wash water flows along the circumferential wall of the rectifying zone 9*b*, turbulence caused by the collision of the shower of wash water against the circumferential wall of the tapered zone 9*a* is relieved.

The converged bubbly stream running through the radial center of the rectifying zone 9*b* passes through the large central hole 4*a*. The cylindrical curtain of the bubbly stream running along the circumferential wall of the rectifying zone 9*b* passes through the numerous small peripheral holes 4*b* disposed radially around the large central hole 4*a*. Thus, a central converged flow and an abundance of fine converged flows uniformly dispersed in the circumferential direction and in the radial direction around the central converged flow are formed downstream of the honeycomb 4. When the bubbly stream passes through the honeycomb 4, its speed diminishes slightly to relieve the turbulence remaining in the bubbly stream still further. A converged bubbly stream relieved of turbulence discharges from the center of the bubbly stream outlet 7. An abundance of fine converged bubbly streams uniformly dispersed in the circumferential direction and in the radial direction and relieved of turbulence discharges from the whole of the bubbly stream outlet 7 except the central portion thereof. The central converged bubbly stream and an abundance of the fine converged bubbly streams uniformly dispersed in the circumferential direction and in the radial direction around the central converged bubbly stream are united just after they have discharged to form a stable, thick converged bubbly stream relieved of turbulence.

The bubbly stream can pass through the honeycomb 4 at a high speed because the size of the holes in the honeycomb 4 is far larger than that of the pores in a rectifying mesh and the flow resistance of the honeycomb is far less than that of a rectifying mesh. Therefore, the water aerator 1 can discharge a shower of wash water at a high speed from pores 2*a* in the pressure reducing disk 2, suck a large quantity of air into the wash water passage 9, and mix a large quantity of air with the wash water.

A part of the wash water striking against the circumferential wall of the tapered zone 9*a* of the wash water passage is reflected by the wall and flows backward along the circumferential wall of the tapered zone 9*a* toward upstream. The backflow collides against the downstream end face of the annulus ring 2*b* for preventing backflow projecting inwardly in radial direction to be directed downstream.

Blocking of the air inlets 3*c* by the backflow of the wash water to the air inlets 3*c* and stoppage of air suction by blocking of the air inlets 3*c* are prevented by the annulus ring 2*b* for preventing backflow.

A part of the bubbly stream running into the rectifying zone 9*b* can run along the circumferential wall of the rectifying zone 9*b* to form a cylindrical water curtain without flying off the downstream end of the tapered zone 9*a* because the circumferential wall of the rectifying zone 9*b* continuously connects with the circumferential wall of the tapered zone 9*a*. The cylindrical water curtain of the bubbly stream passes through the peripheral portion of the honeycomb 4 to form an abundance of fine converged flows uniformly dispersed in the circumferential direction and in the radial direction. The central converged bubbly stream passing through the central portion of the honeycomb 4 and an abundance of the fine converged bubbly streams uniformly dispersed around the central converged bubbly stream are united to form a stable, thick converged bubbly stream. The stable, thick converged bubbly stream visually satisfies the user of a hand washing apparatus equipped with the water aerator.

The pores 2*a* in the pressure reducing disk 2 are disposed along a circle with a diameter larger than that of the downstream end of the tapered zone 9*a* to make it possible to direct the pores 2*a* at right angles to the end faces of the pressure reducing disk 2 and also direct the pores 2*a* to the circumferential wall of the tapered zone 9*a*. Therefore, it is possible to discharge the wash water from the pores 2*a* without deflecting stream lines of the wash water directed at right angles to the end faces of the pressure reducing disk 2. Pressure loss due to deflections of the stream lines of the wash water is not generated. Therefore, a shower of wash water discharges at a high speed from the pores 2*a*.

The flows of the wash water passing through the pores 2*a* do not contract because the corners of the pores 2*a* on the inlet side are rounded. Therefore, a high-speed shower of wash water can discharge from the pores 2*a* because no pressure loss due to the contraction of the flow is generated.

Friction force acting between the shower of wash water and the air is large because the air inlets 3*c* are disposed close to the high-speed shower of wash water before the collision against the circumferential wall of the tapered zone 9*a*. Therefore, it is possible to suck a large quantity of air into the wash water passage 9 and mix a large quantity of air with the wash water.

Flow resistance at the connection of the tapered zone 9*a* with the rectifying zone 9*b* is small because the corner of connection of the circumferential wall of the tapered zone with the circumferential wall of the rectifying zone is rounded. Therefore, reduction of the speed of the bubbly stream at the connection of the tapered zone with the rectifying zone is prevented.

While the bubbly stream runs along the circumferential wall of the rectifying zone 9*b*, the turbulence -in the bubbly stream is relieved. Therefore, the bubbly stream becomes stable, the air bubbles are prevented from uniting with each other, the air bubbles are prevented from increasing in size, and gas-liquid separation is prevented.

The converged bubbly stream running through the radial center of the rectifying zone 9*b* passes through the large central hole 4*a* of the honeycomb 4 without interference from the partitions of the honeycomb and without generating turbulence. The cylindrical curtain of the bubbly stream running along the circumferential wall of the rectifying zone 9*b* passes through the plurality of small peripheral holes 4*b* disposed radially around the large central hole 4*a* to form an abundance of fine converged bubbly streams uniformly dispersed in the circumferential direction and in the radial direction around the converged bubbly stream passing through the large central hole 4*a*. The central converged bubbly stream relieved of turbulence and an abundance of the peripheral fine converged bubbly streams uniformly dispersed around the central converged bubbly stream are united to form a stable, thick converged bubbly stream. The user of a hand washing apparatus equipped with the water aerator is visually satisfied by the stable, thick converged bubbly stream.

The large central hole 4*a* and the small peripheral holes 4*b* of the honeycomb 4 increase in diameter toward the downstream. Therefore, the converged bubbly streams discharging from the large central hole 4*a* and the small peripheral holes 4*b* approach each other to be easily united. The flow speeds of the converged bubbly streams diminish to relieve turbulence in the converged bubbly streams because the sectional areas of the water passages increase toward the downstream.

The central converged bubbly stream and an abundance of the fine converged bubbly streams unite easily because the rectifying zone 9*b* extends downstream beyond the honeycomb 4.

The internal cylinder 3 provided with the air inlets 3*c*, the internal space forming the tapered zone 9*a* and the rectifying zone 9*b*, and the honeycomb 4 and receiving the pressure reducing disk 2 formed integrally with the annulus ring 2*b* for preventing backflow, and the external cylinder receiving the internal cylinder 3 and forming the air passage 10 communicating with the air inlets 3*c* between itself and the internal cylinder 3, constitute the water aerator 1 so as to have a small number of elements, be easy to assemble, and prevent backflow of the wash water to the air inlets.

Figure 4:
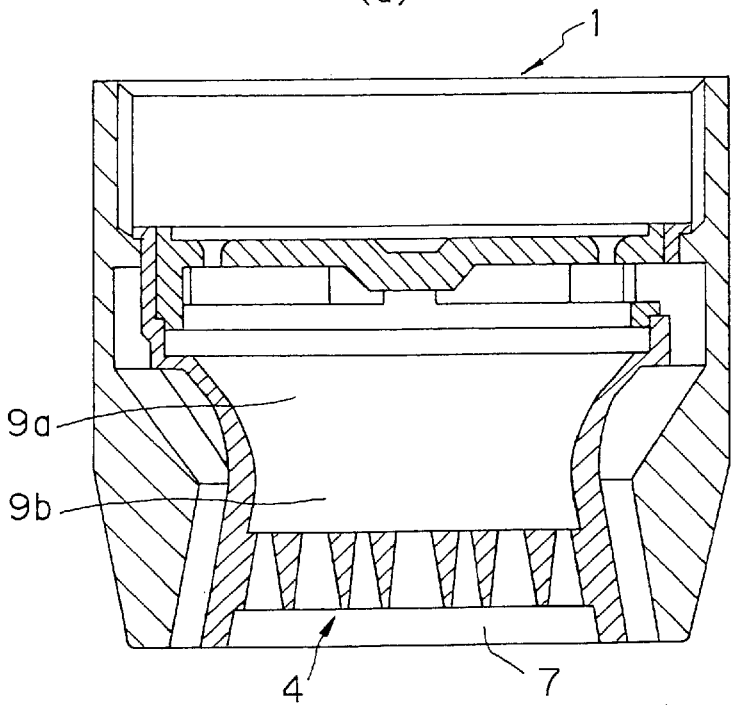
FIG. 4 is a vertical sectional view of a variation of the water aerator in FIG. 1.
Figure 4:
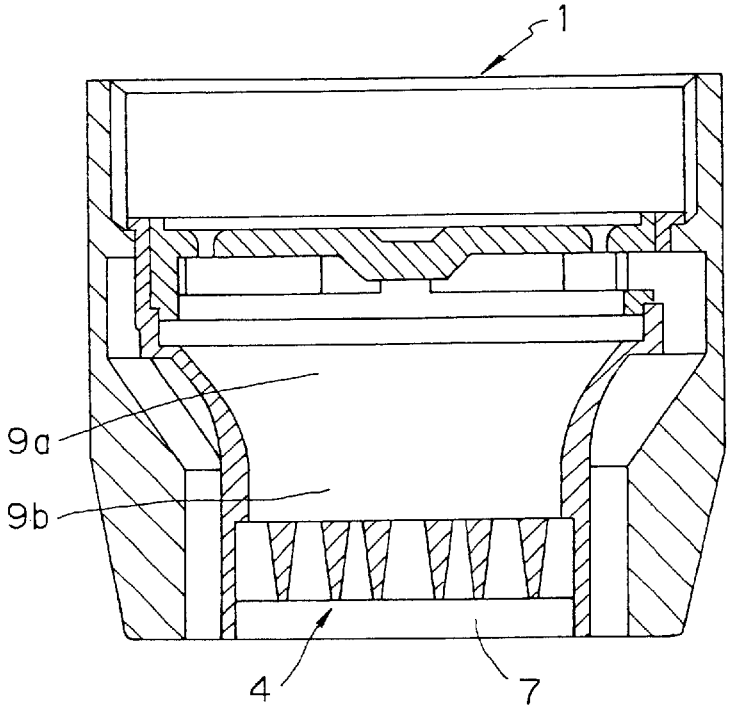

The rectifying zone 9*b* may be increased in diameter toward the downstream as shown in FIG. 4(*a*). The rectifying zone 9*b* may be increased in diameter at its portion downstream of the honeycomb 4 as shown in FIG. 4(*b*). This increases the diameter of the bubbly stream outlet 7, increases the diameter of the bubbly stream discharging from the bubbly stream outlet 7, and enhances the visual satisfaction of the user of the hand washing apparatus equipped with the water aerator.

A flow regulating valve 11 may be disposed in the wash water passage 8 upstream of the pressure reducing disk 2 as indicated by phantom lines in FIG. 1.

Provision of the flow regulating valve 11 suppresses fluctuation of the flow rate of the discharging wash water due to fluctuation of the supply pressure of the wash water and stabilizes the discharging of the wash water.

The apparent flow rate of the wash water increases due to incorporation of the air. The flow rate of the bubbly stream discharging from the bubbly stream outlet 7 can be maintained at the same level as that of the wash water discharging from a conventional hand washing apparatus, i.e., 4 to 6 L/minute, even if the flow rate of the wash water contained in the bubbly stream is reduced from that of the wash water discharging from the conventional hand washing apparatus. The user of a hand washing apparatus equipped with the water aerator in accordance with the present preferred embodiment experiences the same tactual satisfaction through his or her palms owing to the volume of the wash water and the same visual satisfaction owing to the thickness of the stream line of the discharging wash water as he or she obtains when using a conventional hand washing apparatus. Therefore, the water aerator 1 for a hand washing apparatus in accordance with the present preferred embodiment can achieve water saving, while preventing reduction of user's satisfaction.

Conditions for mixing 100 volume % or more of air with wash water having a flow rate of 2.0 to 3.0 L/minute will be discussed.

(1) Thickness of the pressure reducing disk 2 and shape of the inlets of the Pores 2*a*

Considering pipe friction loss of the pores 2*a*, the thickness of the pressure reducing disk 2 is desirably about 1 mm.

Considering the desirable thickness of the pressure reducing disk, the radius of roundness of the inlets of the pores 2*a* is desirably about 0.5 mm.

(2) Total sectional area of the pores 2*a*

The flow speed of the shower of wash water discharging from the pores 2*a* must be 8 to 10 m/sec. in order to mix 100 volume % of the air with the wash water. 3.3 to 4.2 $mm^2$ of total sectional area of the pores 2*a* can achieve the aforementioned flow speed when the flow rate of the wash water is 2 L/min. 5 to 6.3 $mm^2$ of total sectional area of the pores 2*a* can achieve the aforementioned flow speed when the flow rate of the wash water is 3 L/min.

(3) Diameter and number of the pores 2*a*

Considering workability, machining accuracy and clogging with foreign matter, the diameter of the pores 2*a* is desirably 0.5 to 0.75 mm.

The number of the pores 2*a* is desirably large in order to increase the contact area of the shower of wash water with the air. The number of the pores 2*a* is desirably 14 to 20.

(4) Diameter D1 of the circle along which the pores 2*a* are disposed

The diameter of the external thread of a water faucet on which the water aerator 1 is screwed is usually 22 mm. Therefore, the diameter of the wash water inlet 6 is usually 22 mm. The diameter D1 of the circle along which the pores 2*a* are disposed must be smaller than the inner diameter of the annulus ring 2*b* for preventing backflow and smaller than the diameter of the wash water inlet 6. On the other hand, the diameter D1 of the circle along which the pores 2*a* are disposed must be larger than that of the rectifying zone 9*b*. Therefore, D1 is desirably 15 to 16 mm.

(5) Total sectional area and breadth of the air inlets 3*c*

The total sectional area of the air inlets 3*c* is desirably 36 to 90 $mm^2$ in order to mix 100 volume % or more of the air with the wash water having a flow rate of 2.0 to 3.0 L/min. The breadth of the air inlets 3*c* is desirably 1.0 to 1.5 mm.

(6) Inclination, length, etc. of the tapered zone 9*a*

When the inclination θ of the tapered zone 9*a* is too large, the wash water colliding against the circumferential wall of the tapered zone 9*a* flows back to the air inlets 3*c* to reduce the volume of the air mixed with the wash water. When the inclination θ is too small, impact due to the collision of the wash water against the circumferential wall of the tapered zone 9*a* decreases to reduce the volume of the air mixed with the wash water. Therefore, the inclination θ of the tapered zone is desirably 35 to 45 degrees.

The distance from the outlets of the pores 2*a* to the circumferential wall of the tapered zone 9*a* is desirably 4 to 5 mm in order to generate air entrainment due to friction.

Considering that the bubbly stream needs an approach run before it reaches the rectifying zone 9*b*, the length L1 of the tapered zone is desirably about 3 mm.

(7) Inner diameter of the annuls ring 2*b* for preventing backflow

The inner diameter of the annulus ring 2*b* for preventing backflow is desirably about 17 mm in order to avoid interference with the shower of wash water discharging from the pores 2*a*. The outer diameter of the annular recess formed beneath the annulus ring 2*b* for preventing backflow is desirably 18 to 20 mm in order to achieve a sufficient backflow preventing effect.

(8) Length, etc. of the rectifying zone 9*b*

When the radius of roundness of the connection of the circumferential wall of the tapered zone 9*a* with the circumferential wall of the rectifying zone 9*b* is too small, all of the bubbly streams running into the rectifying zone 9*b* gather around the radial center of the rectifying zone 9*b* to form a converged flow. Therefore, the diameter of the bubbly stream discharging from the bubbly stream outlet 7 becomes small to reduce the user's visual satisfaction with the bubbly stream. When the radius of the aforementioned roundness is too large, the tapered zone 9*a* cannot be formed. Therefore, the radius of roundness of the connection of the circumferential wall of the tapered zone 9*a* with the circumferential wall of the rectifying zone 9*b* is desirably 3 to 7 mm.

When the rectifying zone 9*b* upstream of the honeycomb 4 is too short, the bubbly stream is not rectified and the discharging bubbly stream is not stabilized. When the rectifying zone 9*b* upstream of the honeycomb 4 is too long, the water aerator 1 becomes too long. Therefore, the length L2 of the rectifying zone 9*b* upstream of the honeycomb 4 is desirably about 4 mm.

(9) Thickness, shape of holes, etc. of the honeycomb

When the thickness of the honeycomb 4 is too small, flow resistance becomes too small and no rectification effect is obtained. When the thickness of the honeycomb 4 is too large, flow resistance becomes too large, it becomes hard to discharge the wash water at a high speed from the pores 2*a*, and the volume of the air mixed with the wash water diminishes. Therefore, the thickness of the honeycomb 4 is desirably 3 to 4 mm.

The divergence angle of the large central hole 4*a* and the small peripheral holes 4*b* is desirably about 0.5 drgrees.

It is desirable to dispose 2 to 3 rows of the small peripheral holes 4*b* coaxially around the large central hole 4*a*.

The ratio of the hole area of the honeycomb 4 to the bubbly stream outlet 7 is desirably 53 to 63% when providing 2 rows of the small peripheral holes 4*b* and 45 to 55% when providing 3 rows of the small peripheral holes 4*b*. The sectional area of the small peripheral hole 4*b* is desirably 1.5 to 2.5 $mm^2$ when providing 2 rows of the small peripheral holes 4*b* and 0.5 to 2.0 $mm^2$ when providing 3 rows of the small peripheral holes 4*b*. The outermost row desirably includes 20 small peripheral holes 4*b* disposed at a constant pitch, while each of other rows desirably includes 10 small peripheral holes 4*b* disposed at a constant pitch.

(10) Diameter, etc. of the bubbly stream outlet

The length L3 of the rectifying zone 9*b* downstream of the honeycomb 4 is desirably 1.5 mm or more in order to promote uniting of the central converged flow with the abundance of the fine converged flows discharging from the honeycomb 4.

The diameter of the bubbly stream outlet 7 is desirably about 12 mm in order to discharge a bubbly stream with a diameter large enough to visually satisfy the user of the hand washing apparatus equipped with the water aerator. When the diameter of the rectifying zone 9*b* is set the same as that of the bubbly stream outlet 7, the diameter D2 of the rectifying zone 9*b* is about 12 mm.

(11) Relation between the flow rate of the wash water and the volume of the mixed air When the aforementioned conditions are met, it becomes possible to mix 100 volume % of air with the wash water having a flow rate of 2 to 3 L/min., thereby discharging a bubbly stream with a diameter large enough to visually satisfy the user.

Figure 5:
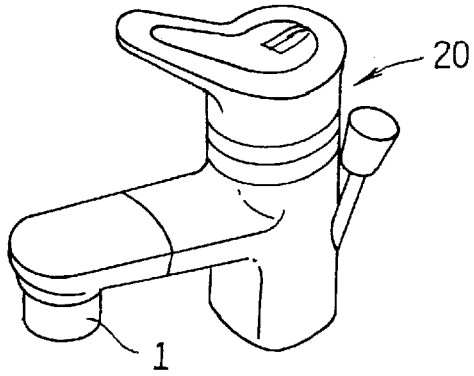
FIG. 5 is a perspective view of a manual hand washing apparatus provided with a water aerator in accordance with a preferred embodiment of the present invention.

A manual hand washing apparatus 20 equipped with the water aerator 1 is shown in FIG. 5. The manual hand washing apparatus 20 discharges a bubbly stream. Therefore, it can give ample visual and tactual satisfaction to the user of the hand washing apparatus even if the user manually controls the flow rate of the wash water to reduce it to 2 to 3 L/min.

Figure 6:
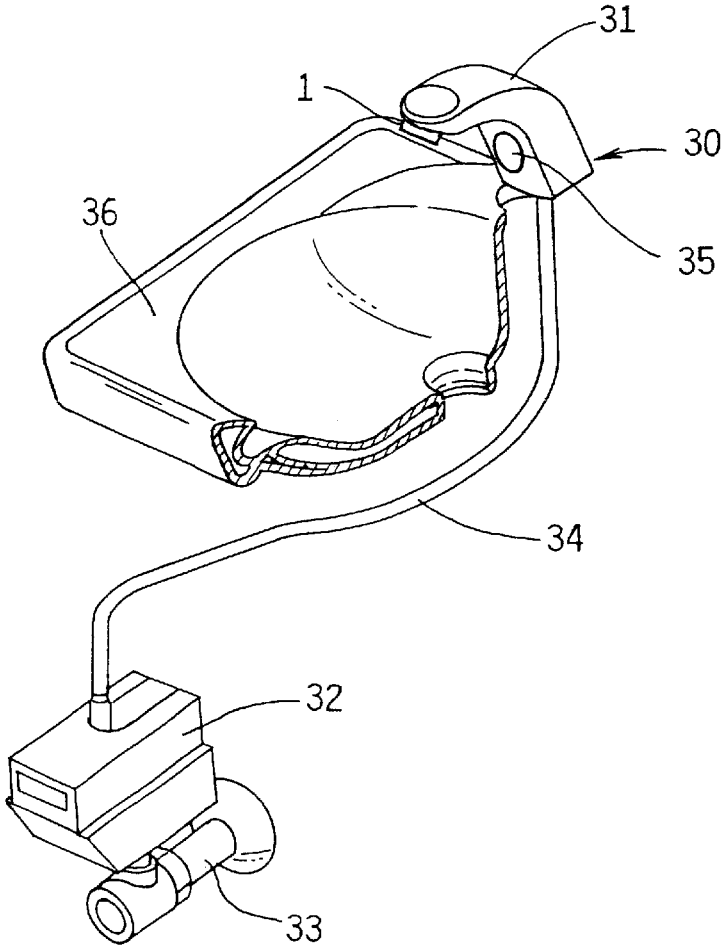
FIG. 6 is a perspective view of an automatic hand washing apparatus provided with a water aerator in accordance with a preferred embodiment of the present invention.
Figure 7:
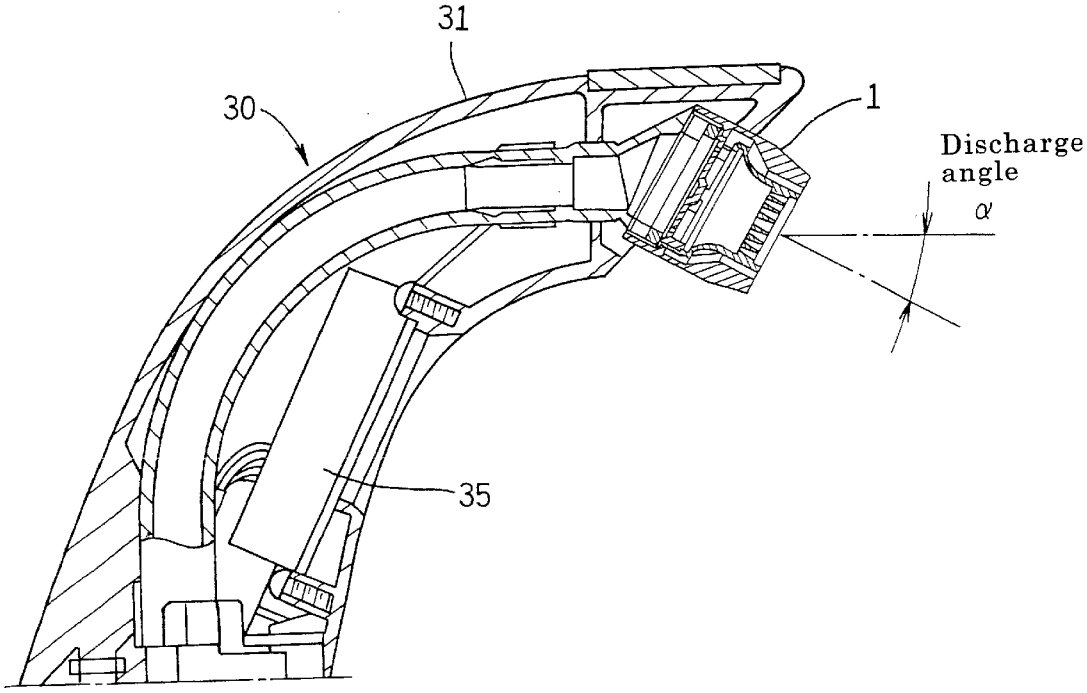
FIG. 7 is a vertical sectional view of an automatic water faucet of an automatic hand washing apparatus provided with a water aerator in accordance with a preferred embodiment of the present invention.

An automatic hand washing apparatus equipped with the water aerator 1 is shown in FIGS. 6 and 7.

An automatic hand washing apparatus 30 is provided with an automatic water faucet 31 having the water aerator 1, an electromagnetic valve 32, a stop valve 33, a hose 34 connecting the automatic water faucet 31 with the electromagnetic valve 32, and a sensor 35 for detecting a user's hands. A flow regulating valve not shown in the figures is disposed between the electromagnetic valve 32 and the stop valve 33. The automatic water faucet 31 is mounted on a washbasin 36 made of earthenware.

When a user of the hand washing apparatus holds his or her hand at the center of the washbasin 36, the sensor 35 detects his or her hands. The electromagnetic valve 32 opens. The flow rate of the wash water is controlled to 2 to 3 L/min. by the flow regulating valve. The wash water is then supplied to the water aerator 1 through the hose 34. A bubbly stream discharges from the water aerator 1. When the sensor 35 no longer detects the user's hands, the electromagnetic valve 32 closes and the discharge of the bubbly stream stops. The automatic hand washing apparatus 30 discharges a bubbly stream. Therefore, it can give ample visual and tactual satisfaction to the user of the hand washing apparatus even if the flow rate of wash water is reduced to 2 to 3 L/min. It is desirable to set the water discharge angle $\alpha$ at 15 to 70 degrees to enhance the user's visual satisfaction with the discharging water.

The automatic hand washing apparatus 30 may be provided with a self-closing cock adapted to open when it is pushed by a user and close after a predetermined volume of wash water passes through it, instead of the sensor 35 and the electromagnetic valve 32. The automatic hand washing apparatus 30 discharges a bubbly stream. Therefore, it can give ample visual and tactual satisfaction to the user of the hand washing apparatus even if the flow rate of wash water is reduced to 2 to 3 L/min.

INDUSTRIAL APPLICABILITY

The water aerator in accordance with the present invention can be used for hand washing apparatuses, water faucets, etc.

What is claimed is:

1. A water aerator comprising an inlet for wash water, an outlet for a bubbly stream, first means for mixing air with wash water disposed in a wash water passage extending between the inlet for wash water and the outlet for the bubbly stream, and second means for rectifying the wash water disposed downstream of the first means, wherein the first means comprises a pressure reducing disk provided with a plurality of pores and blocking the wash water passage, air inlets disposed in a circumferential wall of the wash water passage downstream of the pressure reducing disk, and a tapered zone of the wash water passage with conically diminishing diameter located downstream of the pressure reducing disk, wherein the second means comprises a rectifying zone of the wash water passage extending between the downstream end of the tapered zone and the outlet for the bubbly stream, and a honeycomb disposed in the rectifying zone, and wherein the pores in the pressure reducing disk are directed to a circumferential wall of the tapered zone.

2. A water aerator of claim 1, wherein a circumferential wall of the rectifying zone continuously connects with the circumferential wall of the tapered zone.

3. A water aerator of claim 1, wherein the pores in the pressure reducing disk are disposed at a constant pitch along a circle with a diameter larger than that of the downstream end of the tapered zone of the wash water passage.

4. A water aerator of claim 3, wherein inlet side corners of the pores in the pressure reducing disk are rounded.

5. A water aerator of claim 4, wherein the air inlets are disposed upstream of the tapered zone of the wash water passage.

6. A water aerator of claim 5, wherein a corner at a connection of the circumferential wall of the tapered zone with a circumferential wall of the rectifying zone is rounded.

7. A water aerator of claim 6, wherein the rectifying zone of the wash water passage increases in diameter toward the downstream.

8. A water aerator of claim 7, wherein the honeycomb comprises a central hole and numerous peripheral holes disposed radially around the central hole.

9. A water aerator of claim 8, wherein the holes of the honeycomb increase in diameter toward the downstream.

10. A water aerator of claim 9, wherein the rectifying zone extends downstream beyond the honeycomb.

11. A water aerator of claim 10, further comprising means for preventing backflow of the wash water toward the air inlets.

12. A water aerator of claim 10, further comprising an internal cylinder provided with the air inlets, the tapered zone, the rectifying zone and the honeycomb and receiving the pressure reducing disk, and an external cylinder receiving the internal cylinder and forming an air passage communicating with the air inlets between itself and the internal cylinder.

13. A water aerator of claim 11, further comprising an internal cylinder provided with the air inlets, the tapered zone, the rectifying zone and the honeycomb and receiving the pressure reducing disk united with the means for preventing backflow, and an external cylinder receiving the internal cylinder and forming an air passage communicating with the air inlets between itself and the internal cylinder.

14. A water aerator of claim 13, further comprising a flow regulating valve disposed upstream of the pressure reducing disk.

15. A water aerator of claim 14, wherein the water aerator discharges the bubbly flow at a flow rate of wash water of 2 L/minute and 100 volume % of air mixed with the wash water.

16. A water faucet comprising a water aerator of claim 15.

17. A hand washing apparatus comprising a water aerator of claim 16.

* * * * *